US011199097B2

(12) United States Patent
Varney

(10) Patent No.: US 11,199,097 B2
(45) **Date of Patent: *Dec. 14, 2021**

(54) AIR-FILM COOLED COMPONENT FOR A GAS TURBINE ENGINE

(71) Applicant: Rolls-Royce Corporation, Indianapolis, IN (US)

(72) Inventor: Bruce Edward Varney, Greenwood, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/773,419

(22) Filed: Jan. 27, 2020

(65) Prior Publication Data

US 2020/0165922 A1 May 28, 2020

Related U.S. Application Data

(63) Continuation of application No. 15/672,629, filed on Aug. 9, 2017, now Pat. No. 10,544,683.

(60) Provisional application No. 62/381,403, filed on Aug. 30, 2016.

(51) Int. Cl.

| | |
|---|---|
| ***F01D 5/18*** | (2006.01) |
| ***F01D 25/08*** | (2006.01) |
| ***F01D 9/06*** | (2006.01) |

(52) U.S. Cl.

CPC ..... *F01D 5/186* (2013.01); *F01D 9/065* (2013.01); *F01D 25/08* (2013.01); *F05D 2260/201* (2013.01); *F05D 2260/202* (2013.01)

(58) Field of Classification Search

None

See application file for complete search history.

(56) References Cited

U.S. PATENT DOCUMENTS

| | | | |
|---|---|---|---|
| 4,648,799 | A | 3/1987 | Brown et al. |
| 4,650,395 | A | 3/1987 | Weidner |
| 5,092,735 | A | 3/1992 | Katy et al. |
| 5,640,767 | A | 6/1997 | Jackson et al. |
| 6,172,327 | B1 | 1/2001 | Aleshin et al. |
| 6,199,746 | B1 | 3/2001 | Dupree et al. |

(Continued)

FOREIGN PATENT DOCUMENTS

| | | | |
|---|---|---|---|
| EP | 1803521 | A1 | 7/2007 |
| EP | 1880793 | A2 | 1/2008 |

(Continued)

OTHER PUBLICATIONS

Prosecution History from U.S. Appl. No. 15/672,629, dated Apr. 19, 2019 through Sep. 25, 2019, 37 pp.

*Primary Examiner* — Michael Lebentritt

(74) *Attorney, Agent, or Firm* — Shumaker & Sieffert, P.A.

(57) ABSTRACT

A component for a gas turbine engine that separates a cooling air plenum from a heated gas environment. The component defines a hot section surface adjacent to the heated gas environment having a plurality of cooling apertures fluidically connecting the cooling air plenum to the heated gas environment to allow a cooling air to flow from the cooling air plenum to the heated gas environment through the plurality of cooling apertures. The plurality of cooling apertures each have an aperture diameter of less than about 3 millimeters (mm) and an average surface roughness of less than about 1 micrometer (1 μm).

20 Claims, 6 Drawing Sheets

(56) References Cited

U.S. PATENT DOCUMENTS

| | | | |
|---|---|---|---|
| 6,213,714 | B1 | 4/2001 | Rhodes |
| 6,402,464 | B1 | 6/2002 | Chiu et al. |
| 6,575,702 | B2 | 6/2003 | Jackson et al. |
| 6,602,053 | B2 | 8/2003 | Subramanian et al. |
| 6,761,031 | B2 | 7/2004 | Bunker |
| 6,837,417 | B2 | 1/2005 | Srinivasan |
| 6,932,571 | B2 | 8/2005 | Cunha et al. |
| 7,051,435 | B1 | 5/2006 | Subramanian et al. |
| 7,146,725 | B2 | 12/2006 | Kottilingam et al. |
| 7,395,852 | B1 | 7/2008 | Gurin |
| 7,484,928 | B2 | 2/2009 | Arness et al. |
| 7,517,189 | B2 | 4/2009 | Camus |
| 7,625,180 | B1 | 12/2009 | Liang |
| 7,761,989 | B2 | 7/2010 | Lutz et al. |
| 7,966,707 | B2 | 6/2011 | Szela et al. |
| 8,087,565 | B2 | 1/2012 | Kottilingam et al. |
| 8,096,751 | B2 | 1/2012 | Arrell et al. |
| 8,206,092 | B2 | 6/2012 | Tholen et al. |
| 8,247,733 | B2 | 8/2012 | Zhu |
| 8,356,409 | B2 | 1/2013 | Perret |
| 8,439,636 | B1 | 5/2013 | Liang |
| 8,539,659 | B2 | 9/2013 | Szela et al. |
| 8,555,500 | B2 | 10/2013 | Vossberg et al. |
| 8,875,392 | B2 | 11/2014 | Richter |
| 8,894,367 | B2 | 11/2014 | Lee et al. |
| 9,039,350 | B2 | 5/2015 | Winn |
| 9,200,521 | B2 | 12/2015 | Bunker et al. |
| 9,206,696 | B2 | 12/2015 | Bunker et al. |
| 9,249,491 | B2 | 2/2016 | Bunker et al. |
| 9,863,254 | B2 | 1/2018 | Ceglio et al. |
| 10,544,863 | B2 * | 1/2020 | Takahashi ..... F16H 63/18 |
| 2004/0086635 | A1 | 5/2004 | Grossklaus, Jr. et al. |
| 2005/0217110 | A1 | 10/2005 | Topal |
| 2007/0044306 | A1 | 3/2007 | Szela et al. |
| 2007/0163684 | A1 | 7/2007 | Hu |
| 2008/0011813 | A1 | 1/2008 | Bucci et al. |
| 2009/0026182 | A1 | 1/2009 | Hu et al. |
| 2009/0255116 | A1 | 10/2009 | McMasters et al. |
| 2010/0086397 | A1 | 4/2010 | Varanasi et al. |
| 2012/0156054 | A1 | 6/2012 | Lacy et al. |
| 2012/0222306 | A1 | 9/2012 | Mittendorf et al. |
| 2013/0025288 | A1 | 1/2013 | Cunha et al. |
| 2014/0003948 | A1 | 1/2014 | Dubs et al. |
| 2014/0257551 | A1 | 9/2014 | Junod et al. |
| 2014/0259666 | A1 | 9/2014 | Baughman et al. |
| 2018/0058222 | A1 | 3/2018 | Varney |
| 2018/0073396 | A1 | 3/2018 | Varney |
| 2019/0032493 | A1 | 1/2019 | Barker et al. |

FOREIGN PATENT DOCUMENTS

| | | | |
|---|---|---|---|
| EP | 1884306 | A1 | 2/2008 |
| EP | 2206575 | A1 | 7/2010 |
| EP | 2578720 | A2 | 4/2013 |
| WO | 2012092279 | A1 | 7/2012 |

* cited by examiner

AIR-FILM COOLED COMPONENT FOR A GAS TURBINE ENGINE

RELATED APPLICATIONS

This application is a continuation of U.S. patent application Ser. No. 15/672,629, titled, "AIR-FILM COOLED COMPONENT FOR A GAS TURBINE ENGINE," filed Aug. 9, 2017, which claims the benefit of U.S. Provisional Application Ser. No. 62/381,403, titled, "AIR-FILM COOLED COMPONENT FOR A GAS TURBINE ENGINE," filed Aug. 30, 2016, the entire contents of which are incorporated herein by reference.

TECHNICAL FIELD

The present disclosure relates to gas turbine engines and the cooling aspects of blades, vanes, and other components.

BACKGROUND

Hot section components of a gas turbine engine may be operated in high temperature environments that may approach or exceed the softening or melting points of the materials of the components. Such components may include air foils including, for example turbine blades or vanes which may have one or more surfaces exposed high temperature combustion or exhaust gases flowing across the surface of the competent. Different techniques have been developed to assist with cooling of such components including, for example, application of a thermal barrier coating to the component, construction the component as single or dual walled structure, and passing a cooling fluid, such as air, across or through a portion of the component.

SUMMARY

In some examples, the disclosure describes a component for a gas turbine engine that separates a cooling air plenum from a heated gas environment. The component defines a hot section surface adjacent to the heated gas environment having a plurality of cooling apertures fluidically connecting the cooling air plenum to the heated gas environment to allow a cooling air to flow from the cooling air plenum to the heated gas environment through the plurality of cooling apertures. The plurality of cooling apertures each have an aperture diameter of less than about 3 millimeters (mm) and an average surface roughness of less than about 1 micrometer (1 μm).

In some examples, the disclosure describes a turbine airfoil defining an exterior surface adjacent to a heated gas environment, an internal chamber including a cooling air plenum, and a plurality of cooling apertures along the exterior surface of the turbine airfoil, where the plurality of cooling apertures each include an aperture diameter of less than about 3 millimeters (mm) and an aperture surface roughness of less than about 1 micrometer (1 μm), and where the plurality of cooling apertures form at least part of a fluid connection between the heated gas environment and the cooling air plenum.

In some examples, the disclosure describes a method of forming an article for a gas turbine engine, the method includes forming a plurality of cooling apertures along a surface of a component, wherein the plurality of cooling apertures are each defined by an aperture diameter of less than about 3 millimeters (mm) and an aperture surface roughness of less than about 1 micrometer (1 μm).

The details of one or more examples are set forth in the accompanying drawings and the description below. Other features, objects, and advantages will be apparent from the description and drawings, and from the claims.

DETAILED DESCRIPTION

Figure 1:
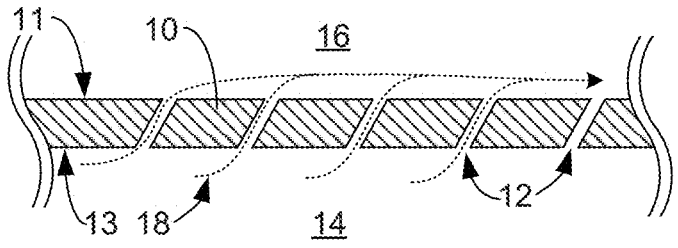
FIG. 1 is a conceptual cross-sectional view of an example component for a gas turbine engine that defines a plurality of cooling apertures.

In general, the disclosure describes an article for a gas turbine engine that includes a component that separates a cooling air plenum from a heated gas environment and includes cooling apertures with a relatively low average surface roughness, such as less than about 1 micrometer (μm) (e.g., about 0.025 μm to about 1 μm). Hot section components, such as a flame tube or combustor liner of a combustor and air foils of a gas turbine engine, may be operated in high temperature gaseous environments. In some such examples, the temperature of the gaseous environments may approach or exceed the operational parameters for the respective component. Indeed, in some instances, operating temperatures in a high pressure turbine section of a gas turbine engine may exceed melting or softening points of the superalloy materials used in turbine components, such as blades or vanes. In some examples, to reduce or substantially eliminate the risk of melting of the engine components, the component may incorporate an air cooling system in which cooling air discharges through cooling apertures in the component. Cooling may be provided by flowing relatively cool air from the compressor section of the turbine engine through passages in the components to be cooled. These passages may exhaust some or all of the cooling air through cooling apertures in the surfaces of the component. In some examples, the exhausted cooling air may protect the component in such high temperature gaseous environments by, for example, reducing the relative temperature of the component, creating a film of cooling air passing over the surface of the component exposed to the high temperature environment, reducing the temperature of the gas within the high temperature environment, or a combination of two or more of these effects. The disclosed examples and techniques described herein may be used to improve the efficiency of such air-cooling systems and components of a gas turbine engine, even in environments that may include a high percentage of airborne fine particulates (e.g., particulates with a diameter of less than about 5 μm).

In some examples, Gas turbine engines may be subjected to environmental particulates (e.g. sand, dust, dirt), which get ingested into the engine; these environmental particulates can then enter the core hot gas path or air-cooling systems. Additionally or alternatively, domestic particulates (e.g. compressor abradable material) can also enter into such systems cooling circuits. Collectively, these airborne particulates may deposit or agglomerate on various components of the engine, leading to reduced efficiency of the cooling system by, for example, adhering to the thermal barrier coating (TBC) of a component or blocking/significantly restricting the flow paths of the cooling system.

For example, fine airborne particulates may get ingested into the cooling-air system of a turbine engine. In some example, the airborne particulate may contact and deposit on various surfaces of the components including, for example, the inner walls of the cooling/impingement apertures. As the fine particulates accumulate within the cooling/impingement apertures, flow of the cooling air through the apertures is reduced, which may hinder cooling of the component, increased local component temperatures, and potentially higher thermal or thermomechanical stresses on the component. By forming the cooling/impingement apertures with a relatively low average surface roughness (e.g., less than about 1 μm), as described herein, a contact area between the fine particulates passing through the cooling/impingement aperture and the wall of the aperture may be reduced. This reduction in contact area may reduce attractive forces between the fine particulates and the wall of the cooling aperture, as the attractive forces may be proportional to the contact area. As a result, a finer surface finish (i.e., a lower average surface roughness) may reduce incidences of fine particulates accumulating within the cooling/impingement apertures.

FIG. 1 is conceptual cross-sectional view of an example component 10 for a gas turbine engine that defines a plurality of cooling apertures 12. Component 10 separates a cooling air plenum 14 from a heated gas environment 16 such that component 10 acts as a physical separator between the two environments. Component 10 includes cooling apertures 12 extending between cooling air plenum 14 and heated gas environment 16. Cooling apertures 12 provide a flow conduit between cooling air plenum 14 and heated gas environment 16 for cooling gas 18 flow as part of the air-cooling system for component 10.

In some examples, component 10 may include a hot section component for a gas turbine engine that receives or transfers cooling air as part of cooling system for the gas turbine engine. Component 10 may include any component of a turbine engine that undergoes active air-cooling including, for example, a component of a combustor such as a flame tube, combustion ring, combustor liner, an inner or outer casing, a guide vane, or the like; a component of a turbine section such as a nozzle guide vane, a turbine disc, a turbine blade, or the like; or another component associated with the hot section (e.g., a combustor or a high, low, or intermediate pressure turbine, or low pressure turbine) of a gas turbine engine. In some examples, component 10 may be constructed with a ceramic matrix composite, a superalloy, and other materials used in for example the aerospace industry. However, component 10 may be formed of any suitable materials, including materials other than those mentioned above.

During operation of component 10, cooling air 18 may pass from cooling air plenum 14 to heated gas environment 16 through the plurality of cooling apertures 12 of component 10. The temperature of the cooling air within cooling air plenum 14 may be less than that of the hot gas environment 16. Cooling air 18 may assist in maintaining the temperature of component 10 at a level lower than that of heated gas environment 16. For example, in addition to contacting a surface of component 10 defining cooling air plenum 14 to cool component 10 by conduction, cooling air 18 may enter heated gas environment 16 through the plurality of cooling apertures 12 and create an insulating film or boundary layer of relatively cool air along surface 11 of component 10. This may contribute to surface 11 of component 10 remaining at a temperature less than that of the bulk temperature of heated gas environment 16. In some examples, cooling air 18 may also at least partially mix with the gas of heated gas environment 16, thereby reducing the temperature of heated gas environment 16, at least adjacent to the plurality of cooling apertures 12. Additionally or alternatively, cooling gas 18 may act as a cooling reservoir that absorbs heat from component 10 as the gas passes through cooling apertures 12 or along one or more of the surfaces of component 10, thereby dissipating the heat of component 10 and allowing the relative temperature of component 10 to be maintained at a temperature less than that of heated gas environment 16.

Cooling air plenum 14 and heated gas environment 16 may represent different flow paths, chambers, or regions within the gas turbine engine in which component 10 is installed. For example, in some examples in which component 10 is a flame tube of a combustor of a gas turbine engine, heated gas environment 16 may comprise the combustion chamber within the flame tube and cooling air plenum 14 may comprise the by-pass/cooling air that flows around the exterior of the flame tube. In some examples where component 10 is a turbine blade or vane, heated gas environment 16 may represent the working gas flow path environment exterior to and the turbine blade or vane while cooling air plenum 14 may comprise one or more interior chambers within the turbine blade or vane representing part of the integral cooling system of the gas turbine engine.

In some examples, cooling air 18 may be supplied to component 10 (e.g., via cooling air plenum 14) at a pressure greater than the gas path pressure within heated gas environment 16. The pressure differential between cooling air plenum 14 and heated gas environment 16 may force cooling air 18 through the plurality of cooling apertures 12.

Plurality of cooling apertures 12 may be positioned in any suitable configuration and location about the surface of component 10. For example, cooling apertures 12 may be positioned along the leading edge of a gas turbine blade or vane. In some examples, cooling aperture 12 may be introduced at an incidence angle less than 90 degrees, e.g., non-perpendicular, to the exterior surface 11 of component 10. In some examples the angle of incidence may be between about 10 degrees and about 75 degrees relative to the exterior surface 11 of component 10 (e.g., with 90 degrees representing a normal to surface 11). In some such examples, adjusting the angle of incidence of cooling aperture 12 may assist with creating a cooling film of cooling air 18 along surface 11 of component 10. Additionally or alternatively, one or more of cooling apertures 12 may include a fanned Coanda ramp path at the point of exit from surface 11 to assist in the distribution or film forming characteristics of cooling air 18 along surface 11 as the cooling air 18 exits the respective cooling aperture 12. In some examples, film cooling holes are shaped to reduce the use of cooling air.

Figure 2:
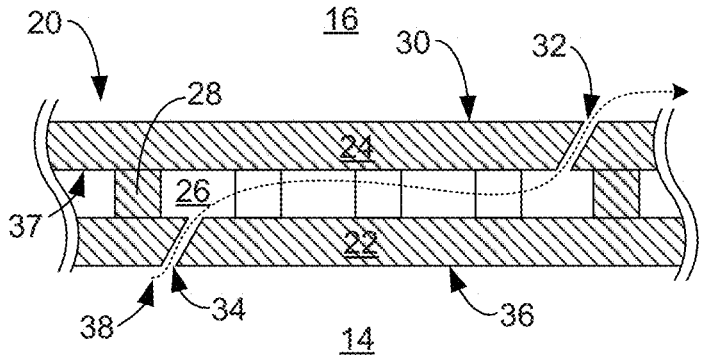
FIG. 2 is conceptual cross-sectional view of an example dual-walled component for a gas turbine engine.

In some examples, component 10 may be a single walled component (e.g., as illustrated in FIG. 1). In other examples, component 10 may be a dual-walled or multi-walled component. For example, FIG. 2 is conceptual cross-sectional view of a portion of an example dual-walled component 20 for a gas turbine engine. Dual-walled component 20 includes a cold section wall 22 adjacent to cooling air plenum 14 and a hot section wall 24 adjacent to heated gas environment 16. The terms "hot section wall" and "cold section wall" are used merely to orient which wall is adjacent to cooling air plenum 14 and which wall is adjacent to heated gas environment 16 and is not intended to limit the relative temperatures of the different environments or walls. For example, while cold section wall 22 and cooling air plenum 14 may described as "cold" sections compared to hot section wall 24 and heated gas environment 16, depending on materials from which cold section wall 22 is formed and the intended design parameters, the respective temperatures of cold section wall 22 or cold-air plenum 14 may reach temperatures between about 1400° F. to about 2400° F. (e.g., about 760° C. to about 1300° C.), but remains cooler than heated gas environment 16 during operation.

In some examples, cold section wall 22 and hot section wall 24 may be separated by a plurality of support structures 28, such as pedestals, creating at least one cooling channel 26 between cold section wall 22 and hot section wall 24. Hot section wall 24 may include a plurality of cooling apertures 32 along surface 30 of hot section wall 24 that extend between cooling channel 26 and heated gas environment 16. Likewise, cold section wall 22 may include a plurality of impingement apertures 34 along surface 36 of cold section wall 22 extending between cooling air plenum 14 and cooling channel 26. During operation, cooling air 38 from cooling air plenum 14 may pass through impingement apertures 34 to cooling channel 26, flow through cooling channel 26, and then flow through cooling aperture 32 into heated gas environment 16. In some examples, the presence of cooling channel 26 may create a zoned temperature gradient between the respective regions of cooling air plenum 14, cooling channel 26, and heated gas environment 16. In some examples, dual-walled component 20 and the presence of cooling channel 26 may allow for more efficient cooling of the structural portions of the component (e.g., cold wall 22) compared to a comparable single walled structure.

In some examples, hot section wall 24 and cold section wall 22 may each define a thickness from about 0.014 inches to about 0.300 inches (e.g., about 0.36 mm to about 7.62 mm).

Plurality of support structures 28 may take on any useful configuration, size, shape, or pattern. In some examples, the height of plurality of support structures 28 may be between about 0.25 millimeters (mm) and about 7 mm to define the height of cooling channel 26. In some examples, plurality of support structures 28 may include a corrugated sheet that separates cold section wall 22 from hot section wall 24 and establishes a plurality of cooling channels 26 between the respective walls. In other examples, plurality of support structures 28 may include a plurality of columns or spires separating cold section wall 22 from hot section wall 24 and creating a network of cooling channels 26 there between. In some examples, plurality of support structures 28 may also include one or more dams that act as zone dividers between adjacent cooling channels 26, thereby separating one cooling channel 26 from another between cold section wall 22 from hot section wall 24. The introduction of dams within component 20 may assist with maintaining a more uniform temperature across hot wall surface 30 of component 20.

Cooling apertures 12, 32 and, if present, impingement apertures 34 of component 10, 20 may be any suitable size, arrangement, or orientation. In some examples, the apertures may define an angle of incidence of about 10 degrees to about 75 degrees (e.g., with 90 degrees representing the perpendicular to a respective surface). In some examples, one or more of cooling apertures 12, 32 may include a fanned Coanda ramp path at the point of exit from surface 11, 30 to assist in the distribution or film characteristics of cooling air 18, 38 as it exits the respective cooling aperture of cooling apertures 12, 32. In some examples, the diameter of cooling apertures 12, 32 and impingement apertures 34 may be about 0.01 inches to about 0.12 inches (e.g., about 0.25 mm to about 3 mm).

In some examples, component 10, 20 may be operated in relatively harsh environments that include a high degree of airborne fine particulates such as sand, dust, or dirt or internal contaminants such as abradable coatings. In some such environments, the airborne particulates may be introduced into the cooling system with the intake of cooling air 18, 38 from the environment and cause interference or disruption to the flow of cooling air 18, 38 through the component, such as by accumulating, blocking, or otherwise impinging one or more of cooling apertures 12, 32 and, if present, impingement apertures 34 of the component. Additionally or alternatively, the airborne particulates may accumulated of the flow surfaces for cooling air 18, 38 including for example, cold-side surface 36 of cold section wall 22 or within cooling channel 26 of component 10. Depending on the degree and extent of any blockage or particle accumulation, the performance of cooling system of component 10, 20 may decrease, leading to operational inefficiencies, reduction in peak performance or maximum operational parameters, overheating of component 10, 20 or adjacent components, early fatigue of component 10, 20 or adjacent components, spallation of coatings on component 10, 20 or adjacent components, damage to portions of component 10, 20 or adjacent components, or the like.

Figure 3:
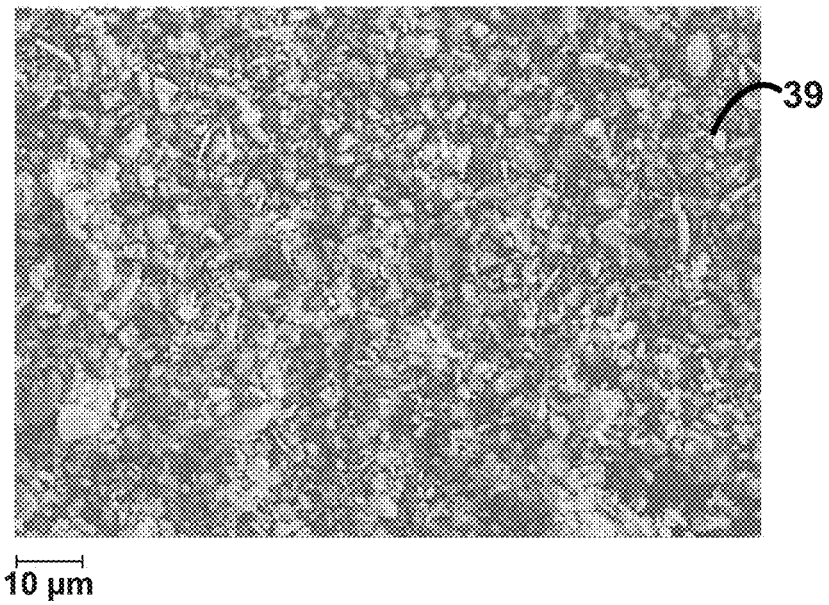
FIG. 3 is a photograph of airborne particulates extracted from a cooling aperture of a conventional turbine blade after being operated in a representatively harsh environment for an extended period of time.

In some examples, the interference or disruption associated with airborne particulates may be reduced by improving the surface finish (reducing an average surface roughness) within one or more of the cooling or impingement apertures (e.g., cooling apertures 12 or 32 or impingement apertures 34), the cooling channels 26, or along cold-side surface 36 of cold section wall 22 (e.g., surface 36). For example, when operating component 10, 20 in relatively harsh environments that include a high degree of airborne particulates, the cooling and impingement apertures have been found to accumulate airborne particulates within the respective apertures, thereby restricting airflow through the aperture. The inventor has discovered that the airborne particulates that typically accumulate within the cooling or impingement apertures have a grain size of less than 5 micrometers (μm) (e.g., on average, less than about 1 μm—sub-micron size) and that such accumulation appears relatively independent of the operational temperature of the gas turbine engine in which the component is installed. The rate of accumulation/blockage may become more pronounced with smaller apertures sizes as less particle matter is needed to block or significantly impede airflow through the aperture. FIG. 3 is a photograph of particulates 39 extracted from the cooling apertures of a turbine blade after being operated in representatively harsh environment for an extended period of time. As can be observed from FIG. 3, the grain size of particulates 39 range from a sub-micron scale to less than about 5 μm, with an average grain size of less than about 1 μm.

Without wanting to be bound to a specific scientific theory, it is believed that that the accumulation of particulates 39 may be the result of the intermolecular forces (e.g., van der Waals force interactions) between the airborne particulates and one or more surfaces of the component, for example, the surface of the cooling or impingement apertures. These intermolecular forces are proportional to the contact area between the particulates and the surface of the cooling or impingement apertures. Because of this, in some examples, the potential attraction forces between the airborne particulates and the respective contact surface (e.g., surface of the cooling or impingement apertures) may be reduced by improving the surface finish, as improving the surface finish may reduce contact area between the particulates and the contact surface.

Figure 4A:
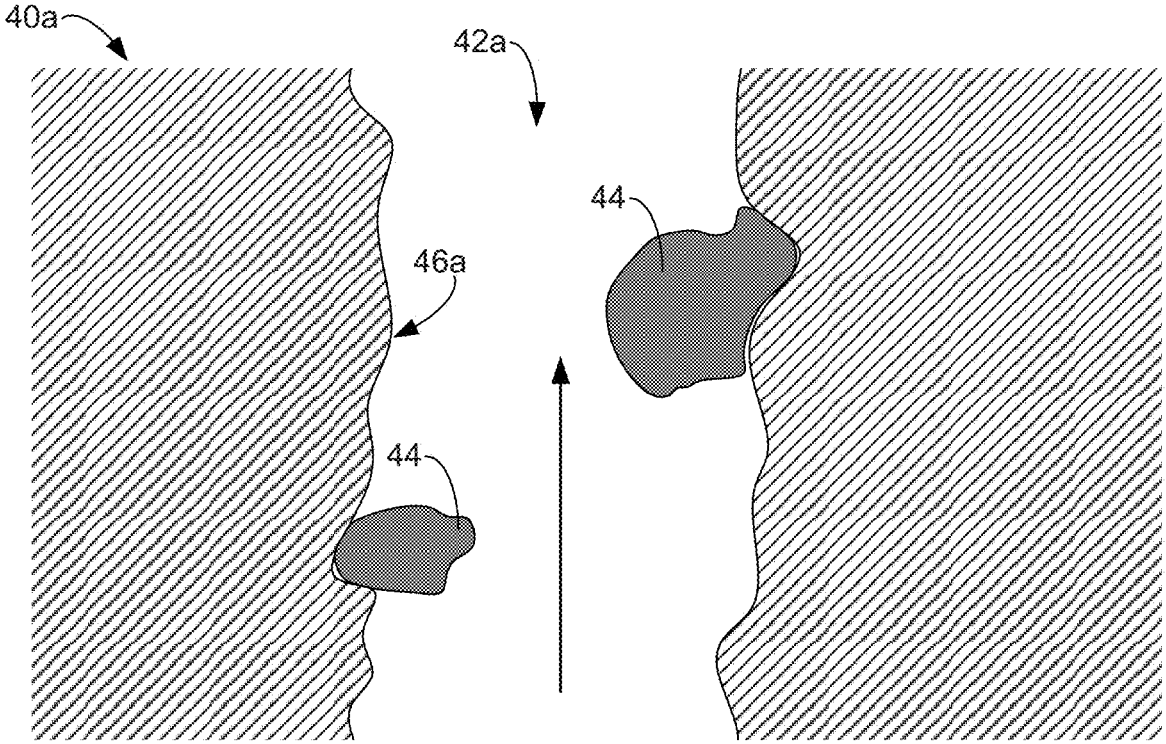
FIGS. 4A and 4B are conceptual schematic drawings of example components that include cooling/impingement apertures that exhibit different surface finishes.
Figure 4B:
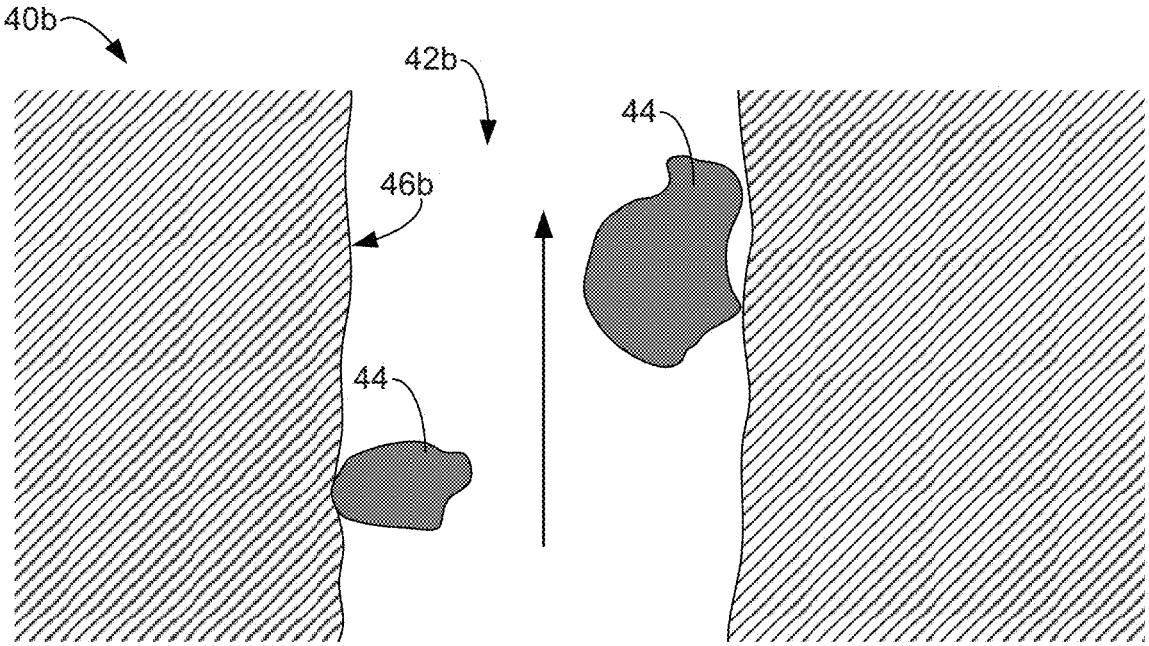

For example, FIGS. 4A and 4B are conceptual schematic drawings of a component 40*a*, 40*b*, that includes a cooling/impingement aperture 42*a*, 42*b* respectively. FIG. 4A, illustrates cooling/impingement aperture 42*a* with a relatively higher average surface roughness (a rougher surface finish). As shown, while cooling/impingement aperture 42*a* may have a visually smooth appearance, the microstructure of the surface of cooling/impingement aperture 42*a* (e.g., surface 46*a*) may remain relatively rough. As airborne particulates 44 flow into cooling/impingement aperture 42*a* and contact surface 46*a* of the walls of cooling/impingement aperture 42*a*, the intermolecular interactions between airborne particulates 44 and surface 46*a* of component 40*a* cause particulates to stick and accumulate to surface 46*a*. In some examples, the intermolecular interactions may become most pronounced if curvature of the topical microstructure of surface 46*a* is substantially similar to the curvature of airborne particulates 44 (e.g., where the peaks and valleys of surface 46*a* are approximately the same size as airborne particulates), as this may increase the contact area between the particulates and the surface.

In some examples, the intermolecular interactions between airborne particulates 44 and surface 46*a* of component 40*a* may be reduced by improving surface finish of surface 46*a* (e.g., reduce the relative roughness of surface 46*a*). FIG. 4B illustrates cooling/impingement aperture 42*b*, exhibiting an improved surface finish (e.g., a lower average surface roughness of surface 46*b*) compared to that of cooling/impingement aperture 42*a*. As shown, the improved surface finish of surface 46*b* may decrease the contact area between surface 46*b* and airborne particulates 44, thereby reducing the intermolecular interactions between the two components. Accordingly, airborne particulates 44 may be less likely to stick or accumulate to surface 46*b* as compared to surface 46*a*, thereby reducing the likelihood of airborne particulates 44 clogging or impeding flow of cooling air through cooling/impingement aperture 42*b*. In some examples, the average surface roughness of cooling/impingement aperture 42*b* (e.g., roughness of or surface 46*b*) may be less than about 1 micrometer (μm). As used herein, a "fine surface finish" is used to describe an average surface roughens of less than about 1 μm.

In some examples, the efficiency of the cooling system may be improved by improving the surface finish along one or more of the flow surfaces of the respective component. For example, the surface finish of one or more of cold-side surfaces 13, 36, 37 of component 10, 20 may be polished or machined to a fine surface finish. The resultant fine surface finish along one or more of cold-side surfaces 13, 36, 37 may reduce the accumulation of airborne particulates on the respective surface during extended operation of component 10, 20 within harsh environments leading to improved cooling efficiency.

Cooling apertures 12, 32 and, if present, impingement apertures 34 of component 10, 20 may be formed using any suitable technique that results in the respective surfaces of cooling apertures 12, 32 or impingement apertures 34 exhibiting a fine surface finish (i.e., a surface roughness less than about 1 μm). For example, one or more of cooling apertures 12, 32 and impingement apertures 34 may be initially formed using a high-speed mechanical machining process, such as drilling; a picosecond or femtosecond pulsed laser; or electro-chemical machining. In some examples, the high-speed mechanical drilling process may include the use of a high speed 5-axis machining with coated carbide cutters. As compared to cooling holes formed by other techniques (e.g., laser or EDM processes), machined cooling apertures can have features that are more sophisticated, thereby allowing more precise control of aperture characteristics and cooling airflow.

In some examples, after initial formation of cooling apertures 12, 32 or impingement apertures 34, the respective apertures may be subjected to subsequent processing to impart a fine surface finish along the surface (e.g., surface 46*b* of FIG. 4B) of the respective aperture. For example, in some examples after initial formation of cooling apertures 12, 32 or impingement apertures 34, at least cooling apertures 12, 32 or impingement apertures 34 of the respective component may be subjected to abrasive flow machining to reduce the average surface roughness within respective cooling apertures 12, 32 or impingement apertures 34 to a roughness less than about 1 μm. In some such examples, the abrasive flow may include a carrier fluid such as air, an oil or polymer based media, or water; and an abrasive component such as silicon carbide, silicon nitride, or the like. The relative size of the abrasive component may be selected to be substantially less than the respective diameter of cooling apertures 12, 32 or impingement apertures 34. In some examples, the abrasive component may define an average particle size of about 1 μm to about 150 μm. In some examples, where the component includes a dual-walled (e.g., component 20), the abrasive flow machining may be applied to the respective walls of the dual-walled (e.g., hot section wall 24 and cold section wall 22) prior to uniting the parts via brazing, diffusion bonding, or the like. Additionally or alternatively, the abrasive flow may be used to impart a fine surface finish on one or more of cold-side surfaces 13, 36, 37 of components 10, 20.

Figure 5:
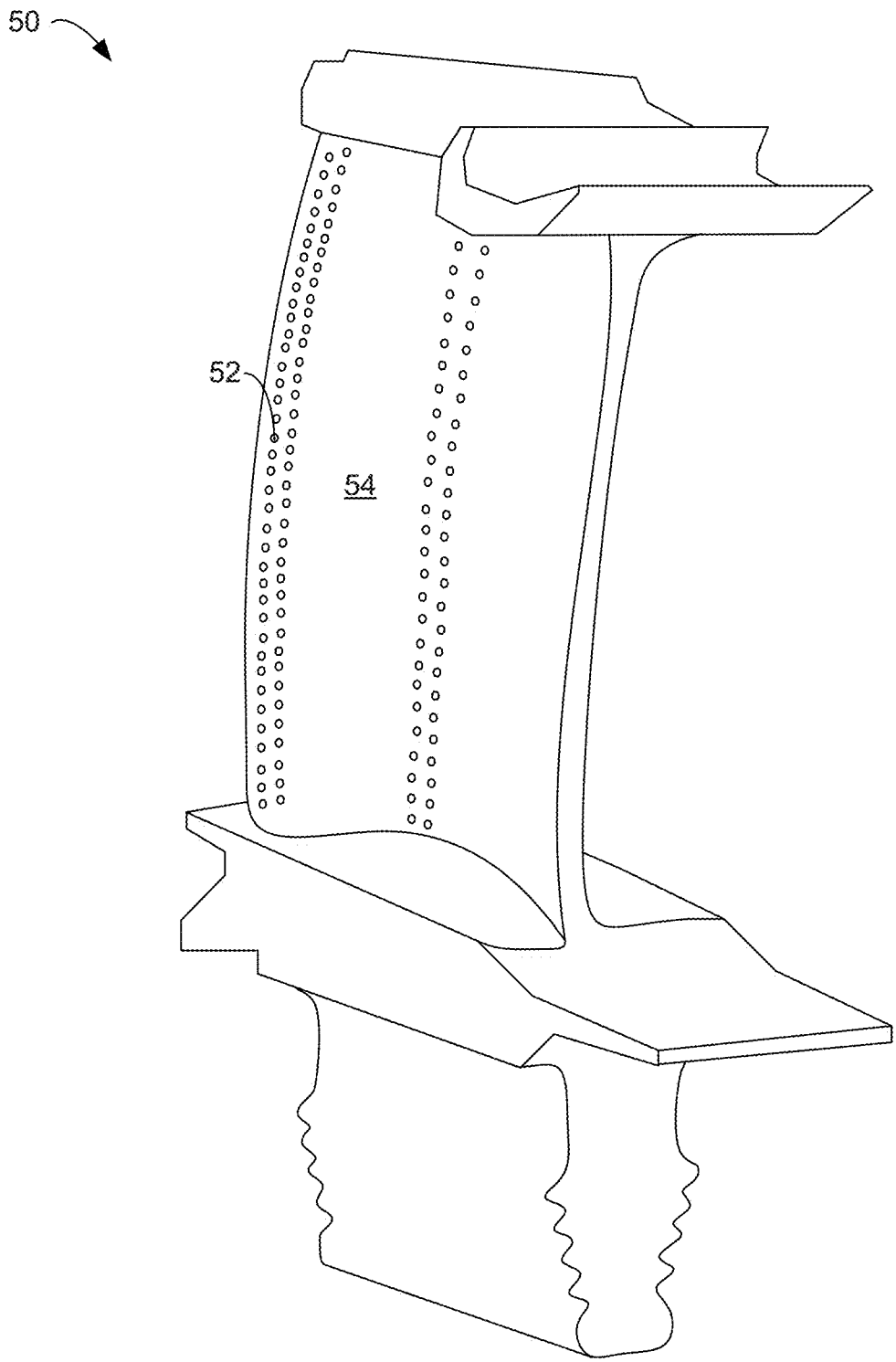
FIGS. 5-7 are conceptual diagrams of example turbine airfoil components for use in a gas turbine engine that each include a plurality of cooling/impingement apertures that exhibit a fine surface finish.
Figure 6:
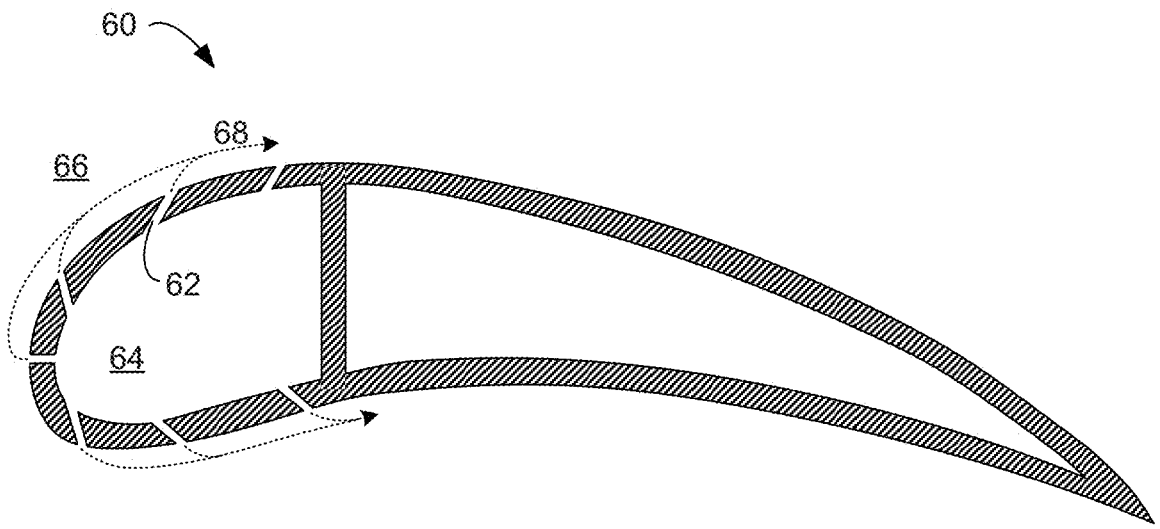
Figure 7:
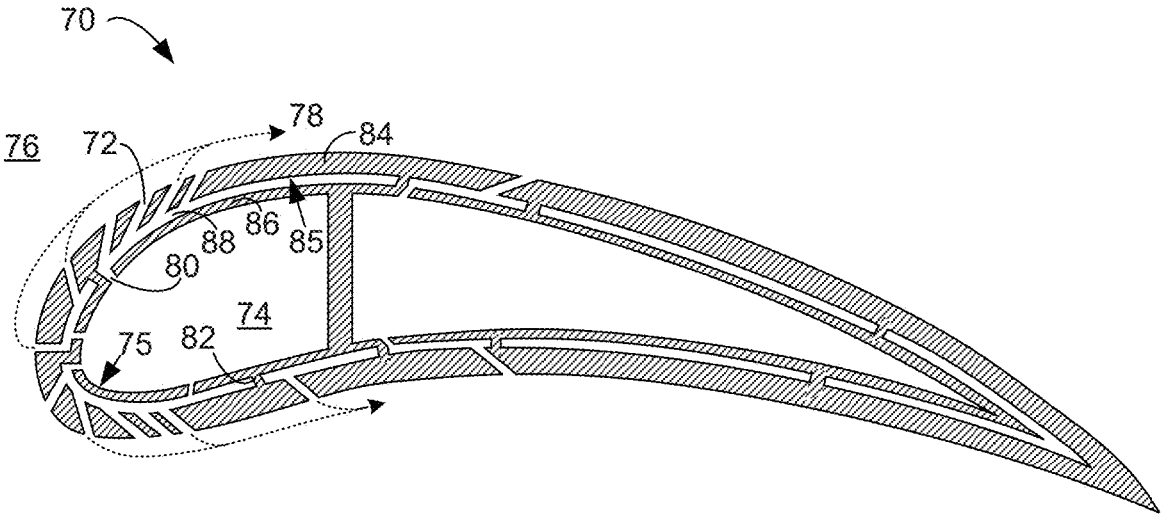

FIGS. 5-7 are conceptual diagrams of example turbine airfoil components (e.g., turbine blade or vane) for use in a gas turbine engine, where the airfoil components include plurality of cooling apertures as disclosed herein. For example, FIG. 5 illustrates an example turbine airfoil 50 that includes a plurality of cooling apertures 52 arranged on the hot section wall surface 54 of the airfoil. The cooling apertures 52 may be formed to exhibit a fine surface finish (i.e., a surface roughness less than about 1 μm) using one or more of the techniques described above.

Turbine airfoil 50 may be a single, dual, or multi-walled structure as described above. For example, FIG. 6 illustrates a cross-sectional view of an example single-walled turbine airfoil 60 that includes a plurality of cooling apertures 62 that be formed to exhibit a fine surface finish. In some such example, cooling air 68 may flow from inner cooling air plenum 64 through cooling apertures 62 into heated gas environment 66. Comparatively, FIG. 7 illustrates a cross-sectional view of an example dual-walled turbine airfoil 60 that includes a plurality of cooling apertures 72 along a hot section wall 84 and a plurality of impingement apertures 80 along a cold section wall 86. In some examples, dual-walled turbine airfoil 70 may have substantially the same structural configuration as dual-walled component 20 with one or more of cooling apertures 72, impingement apertures 80, surface 75, or surface 85 formed to exhibit a fine surface finish. As shown, cooling air 78 may flow form inner cooling air plenum 74 through impingement apertures 80 into cooling channels 88 defined by support structures 82, before exiting through cooling apertures 72 into heated gas environment 76.

In some examples, turbine airfoil 50 may include an impingement tube or an impingement plate type construction. Similar to dual-walled turbine airfoil 60 an impingement tube or impingement plate includes a hot section wall and a cold section wall (e.g., the impingement tube or plate) separated from one another to form a cooling channel in between the respective walls. The respective hot section and cold section walls may respectively include cooling apertures and impingement apertures. An impingement tube or impingement plate may differ from dual-walled turbine airfoil 60 by a reduction or lack of a plurality of support structures 82 (e.g., the cold section and hot section walls are not diffusion bonded together via support structures).

Figure 8:
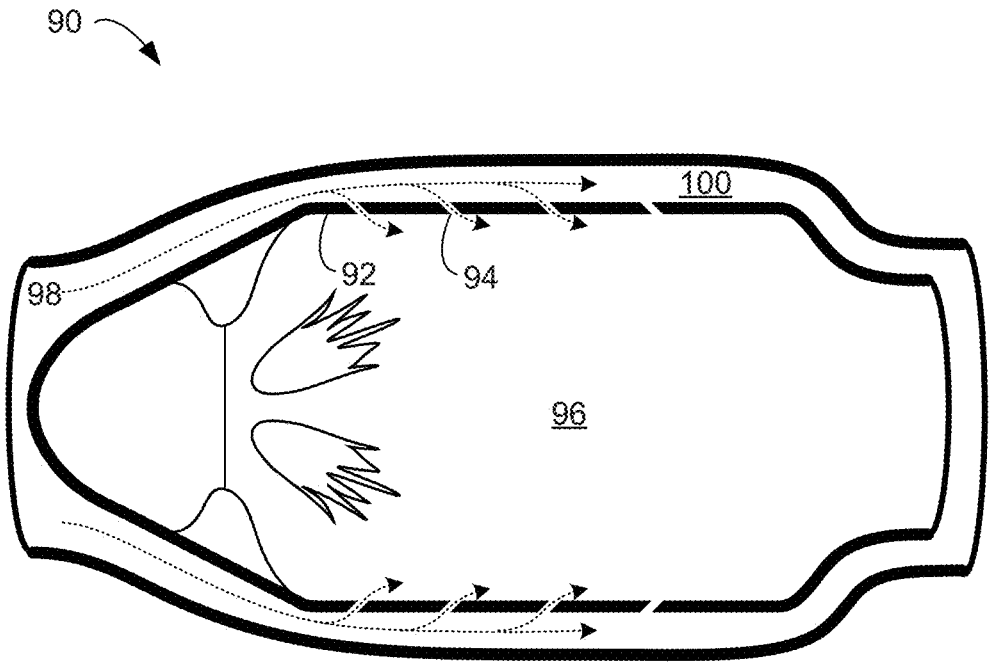
FIG. 8 is a cross-sectional view of an example combustor that includes a flame tube with a sidewall defining a plurality of cooling apertures that exhibit a fine surface finish.

FIG. 8 illustrates a cross-sectional view of an example combustor 90 that includes a flame tube 92 (e.g., combustion chamber) with a sidewall defining a plurality of cooling apertures 94 formed to exhibit a fine surface finish. In some examples, the gases within the combustor post combustion (e.g., heated gas environment 96) may exceed about 1,800 degrees Celsius, which may be too hot for introduction against the vanes and blade of the high pressure turbine (e.g., FIGS. 5-7). In some examples, the combusted gases may be initially cooled prior to being introduced against the vanes and blades of the turbine by progressively introducing portions of the by-pass air (e.g., cooling air 98) into heated gas environment 96 of flame tube 92 via ingress through plurality of cooling aperture 94 strategically position around flame tube 94, fluidly connecting cooling air 98 within cooling air plenum 100 with heated gas environment 96. In some examples, cooling air 98 may intimately mix with the combusted gases to decease the resultant temperature of the volume of heated gas environment 96. Additionally or alternatively, cooling air 98 may form an insulating cooling air film along the interior surface (e.g., hot section surface) of flame tube 92. In some examples, the wall of flame tube may be a single-walled (e.g., component 10) or a dual-walled (e.g., component 20) structure.

Figure 9:
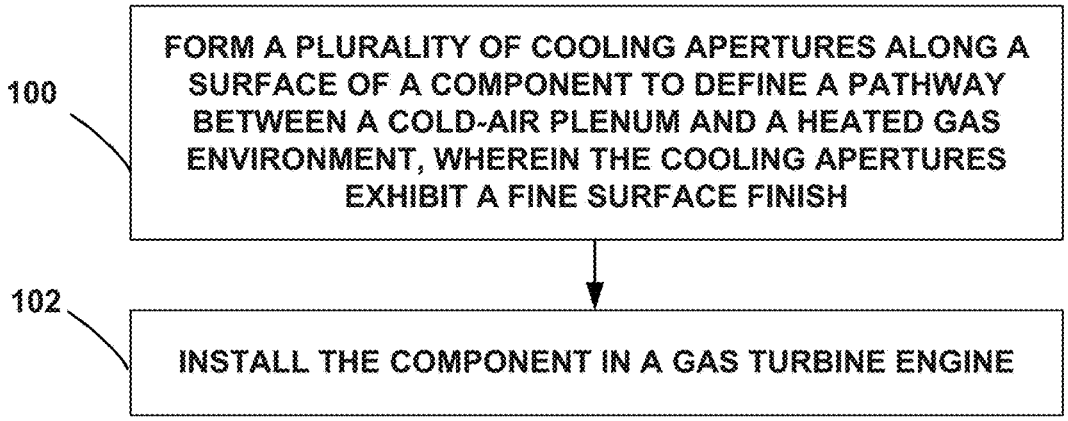
FIGS. 9 and 10 are flow diagrams illustrating example techniques for forming components of a gas turbine engine that include a plurality of cooling apertures, a plurality of impingement apertures, or both that exhibit a fine surface finish.
Figure 10:
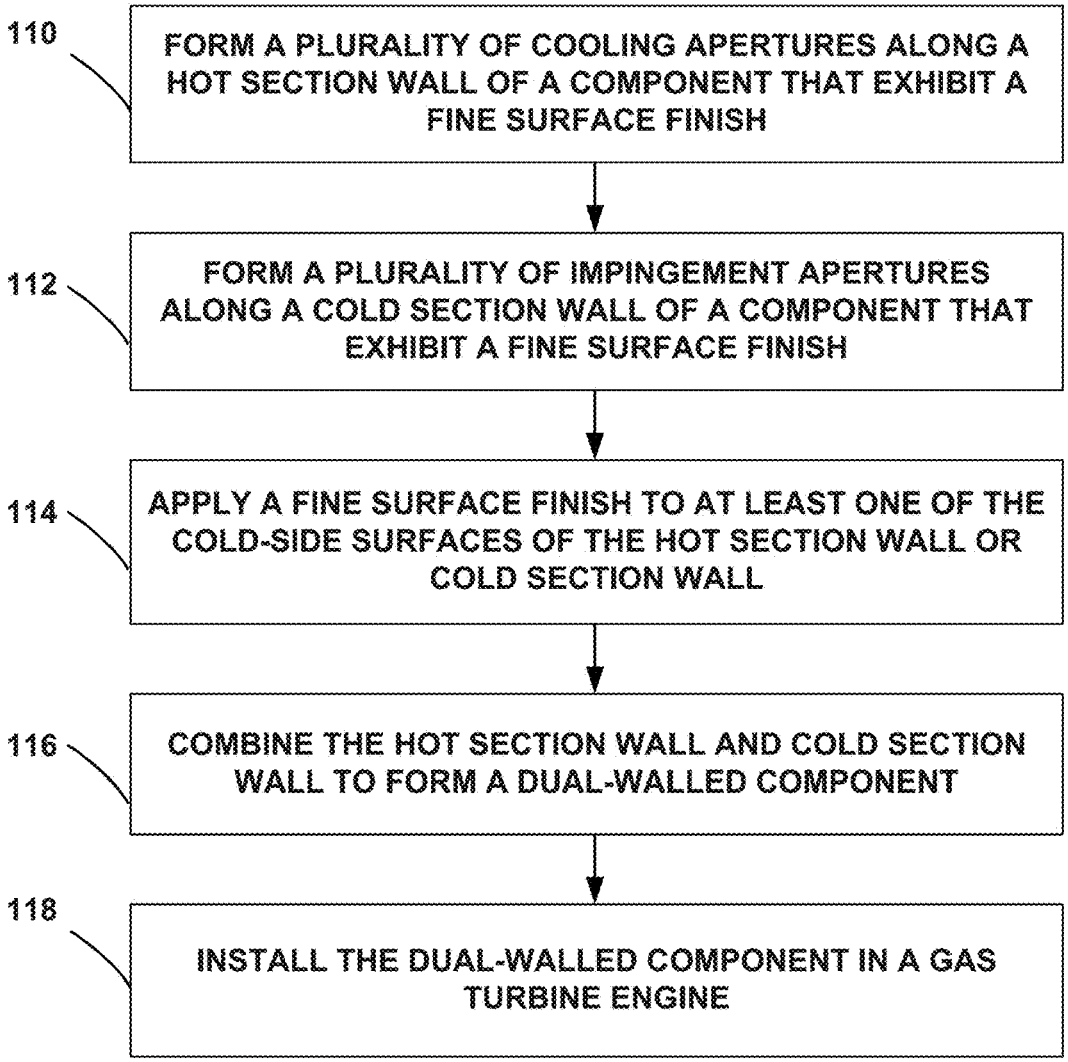

FIGS. 9 and 10 are flow diagrams illustrating example techniques for forming components of a gas turbine engine that include a plurality of cooling apertures or impingement apertures that exhibit a fine surface finish. While the below techniques of FIGS. 9 and 10 are described with respect to components 10, 20 of FIGS. 1 and 2, it will be understood from the context of the specification that the techniques of FIGS. 9 and 10 may be applied to other components of a gas turbine engine including, for example, components 50, 60, 70, and 90, flame tubes, combustor rings, combustion chambers, casings of combustion chambers, turbine blades, turbine vanes, or the like; all of which are envisioned within the scope of the techniques of FIGS. 9 and 10.

The technique of FIG. 9 includes forming a plurality of cooling apertures 12 along a surface 11 of a component 10 to define a pathway between a cooling air plenum 14 and a heated gas environment 16, wherein cooling apertures 12 exhibit a fine surface finish (i.e., a surface roughness less than about 1 μm) (100) and installing component 10 in a gas turbine engine (102). As described above, component 10 may include, for example, a component of a combustor such as a flame tube, combustion ring, combustor liner, inner or outer casing, guide vane, or the like; a component of a turbine section such as a nozzle guide vane, a turbine disc, a turbine blade, a turbine vane, or the like; or another component associated with the air-cooling system of a gas turbine engine. In some examples, component 10 may be a single-walled structure or a dual walled structure.

Plurality of cooling apertures 12 may be formed using any suitable technique to impart a fine surface finish along the inner bore of respective aperture. In some examples, cooling apertures 12 may be formed using a high-speed mechanical drilling process, a picosecond or femtosecond pulsed laser, or electro-chemical machining. Additionally or alternatively, once formed, the cooling apertures 12 may be optionally subjected to an abrasive flow to further enhance the surface finish along the interior bore of the cooling apertures 12. As described above, cooling apertures 12 may be any suitable size, arrangement or orientation. In some examples, the apertures may define an angle of incidence of about 10 degrees to about 75 degrees and define a bore diameter of about 0.01 inches to about 0.12 inches (e.g., about 0.25 mm to about 3 mm).

Once formed, component 10 may be installed in a gas turbine engine (102) and connected to the air cooling system of the engine.

FIG. 10 is another flow diagram illustrating an example technique for forming a dual-walled component 20 of a gas turbine engine that includes a plurality of cooling apertures 32 and impingement apertures 34 that exhibit a fine surface finish. The technique of FIG. 10 includes forming a plurality of cooling apertures 32 along a hot section wall 24 of a component 20 that exhibit a fine surface finish (110), forming a plurality of impingement apertures 34 along a cold section wall 22 of a component 20 that exhibit a fine surface finish (112), optionally applying a fine surface finish to at least one cold-side surface 36, 37 of hot section wall 24 or cold section wall 22 (114), combining the hot section wall 24 and cold section wall 22 to form a dual-walled component 20 (116), and installing the dual-walled component in a gas turbine engine (118).

As discussed above, plurality of cooling apertures 32 and impingement apertures 34 may be formed using any suitable technique to impart a fine surface finish along the inner bore of respective aperture. In some examples, the respective cooling apertures 32 and impingement apertures 34 may be formed using a high-speed mechanical drilling process, a picosecond or femtosecond pulsed laser, or electro-chemical machining. In some examples, once formed, the surface finish along the interior bore of the cooling apertures 32 and impingement apertures 34 may be improved by optionally subjecting the respective hot section wall 24 or cold section wall 22 to an abrasive flow technique to further enhance the surface finishes of the respective apertures. In such examples, the respective hot section wall 24 or cold section wall 22 may be thoroughly cleaned prior to uniting the two walls. As described above, in some examples, dual-wall walled component 20 may include a plurality of pedestals 28 that separate hot section wall 24 and cold section wall 22 to define a cooling channel 26 there between.

As described above, cooling apertures 32 and impingement apertures 34 may be any suitable size, arrangement or orientation. In some examples, the apertures may define an angle of incidence of about 10 degrees to about 75 degrees and define a bore diameter of about 0.01 inches to about 0.12 inches (e.g., about 0.25 mm to about 3 mm).

The respective hot section wall 24 and cold section wall 22 of component 20 may be formed using a suitable technique including, for example, casting, mechanical machining, additive manufacturing, or the like. Once formed, one or more of cold side surfaces 36, 37 of the respective hot section wall 24 and cold section wall 22 may be optionally machined or polished (e.g., via abrasive flow or other machining techniques) to exhibit a fine surface finish (114). The respective walls may then be combined together (116) using, for example, a suitable brazing or diffusion bonding technique to unite the hot section wall 24 and cold section wall 22 together to form the dual-walled structure. Once formed, component 20 may be installed in a gas turbine engine (118) and connected to the air cooling system of the turbine engine.

Various examples have been described. These and other examples are within the scope of the following claims.

What is claimed is:

1. An article for a gas turbine engine comprising:

a component separating a cooling air plenum from a heated gas environment, wherein the component defines a hot section surface adjacent to the heated gas environment, wherein the hot section surface defines a plurality of cooling apertures fluidically connecting the cooling air plenum to the heated gas environment to allow a cooling air to flow from the cooling air plenum to the heated gas environment through the plurality of cooling apertures, wherein the plurality of cooling apertures define an angle of incidence with the hot section surface that is less than 90 degrees and comprise an aperture surface having average surface roughness of less than about 1 micrometer (1 μm).

2. The article of claim 1, wherein the angle of incidence is between about 10 degrees and about 75 degrees.

3. The article of claim 1, wherein the component comprises a single-walled structure separating the cooling air plenum from the heated gas environment.

4. The article of claim 1, wherein the component comprises:

a hot section wall comprising the hot section surface; and a cold section wall having a surface adjacent to the cooling air plenum, wherein the cold section wall defines a plurality of impingement apertures that extend through a thickness of the cold section wall;

wherein the hot section wall and the cold section wall are positioned adjacent to each other to define at least one cooling channel between the cold section wall and the hot section wall; and wherein the plurality of impingement apertures, the at least one cooling channel, and the plurality of cooling apertures fluidically connect the cooling air plenum to the heated gas environment.

5. The article of claim 4, wherein the component comprises a flame tube, a combustion ring, a combustor casing, a combustor guide vane, a turbine vane, a turbine disc, or a turbine blade.

6. The article of claim 4, wherein the component is a dual-walled component, wherein the dual-walled component further comprises:

a plurality of support structures that connect the cold section wall to the hot section wall to define the at least one cooling channel between the cold section wall and the hot section wall.

7. The article of claim 4, wherein the plurality of impingement apertures each comprise an aperture surface having average surface roughness of less than about 1 micrometer (1 μm).

8. The article of claim 1, wherein the component defines a cold-side surface adjacent to the cooling air plenum that comprises an average surface roughness of less than about 1 micrometer (1 μm).

9. An article for a gas turbine engine comprising:

a turbine airfoil defining an exterior surface adjacent to a heated gas environment, an internal chamber comprising a cooling air plenum, and a plurality of cooling apertures along the exterior surface of the turbine airfoil, wherein the plurality of cooling apertures define an angle of incidence with the exterior surface that is less than 90 degrees and comprise an aperture surface roughness of less than about 1 micrometer (1 μm), and wherein the plurality of cooling apertures form at least part of a fluid connection between the heated gas environment and the cooling air plenum.

10. The article of claim 9, wherein the angle of incidence is between about 10 degrees and about 75 degrees.

11. The article of claim 9, wherein the turbine airfoil comprises a single-walled structure separating the cooling air plenum from the heated gas environment.

12. The article of claim 11, wherein the turbine airfoil defines a cold-side surface adjacent to the cooling air plenum that comprises an average surface roughness of less than about 1 micrometer (1 μm).

13. The article of claim 9, wherein the turbine airfoil comprises:

a hot section wall defining the exterior surface adjacent to the heated gas environment;

a cold section wall having a cold-side surface adjacent to the cooling air plenum, wherein the cold section wall defines a plurality of impingement apertures that extend through a thickness of the cold section wall, wherein the plurality of impingement apertures each comprise an aperture surface having average surface roughness of less than about 1 micrometer (1 μm);

wherein the hot section wall and the cold section wall are positioned adjacent to each other to define at least one cooling channel between the cold section wall and the hot section wall; and wherein the plurality of impingement apertures, the at least one cooling channel, and the plurality of cooling apertures fluidically connect the cooling air plenum to the heated gas environment.

14. The article of claim 13, wherein the component is a dual-walled component, wherein the dual-walled component further comprises:

a plurality of support structures that connect the cold section wall to the hot section wall to define the at least one cooling channel between the cold section wall and the hot section wall.

15. The article of claim 13, wherein at least one of the cold-side surface of the cold section wall or a surface of the hot section wall adjacent to the at least one cooling channel comprises an average surface roughness of less than about 1 micrometer (1 μm).

16. A method of forming an article for a gas turbine engine, the method comprising:

forming a plurality of cooling apertures along a surface of a component, wherein the plurality of cooling apertures define an angle of incidence with the surface that is less than 90 degrees and comprise an aperture surface roughness of less than about 1 micrometer (1 μm).

17. The method of claim 16, wherein the angle of incidence is between about 10 degrees and about 75 degrees.

18. The method of claim 16, wherein forming the plurality of cooling apertures comprises forming the cooling apertures using high-speed mechanical drilling process, a picosecond or femtosecond pulsed laser, or electro-chemical machining.

19. The method of claim 16, wherein forming the plurality of cooling apertures comprises applying an abrasive flow to the cooling apertures after forming the cooling apertures.

20. The method of claim 16, wherein the component comprises a hot section wall and a cold section wall, wherein the hot section wall and the cold section wall define a cooling channel between the hot section wall and the cold section wall;

wherein forming the plurality of cooling apertures on the surface of the component comprises forming the cooling apertures in the hot section wall of the component, the method further comprising:

forming a plurality of impingement apertures in a surface of the cold section wall of the component, wherein the plurality of impingement apertures each comprise an aperture surface having average surface roughness of less than about 1 micrometer (1 μm), wherein the plurality of impingement apertures, the cooling channel, and the plurality of cooling apertures are fluidically connected.

* * * * *